United States Patent [19]

Tezuka et al.

[11] 4,111,117

[45] Sep. 5, 1978

[54] SELECTING MECHANISM FOR PRINTING TYPE RINGS

[76] Inventors: Chikao Tezuka; Hitoshi Mikoshiba, both of 80, Oaza-hirookaharashinden, Shiojiri-shi, Nagano-ken, Japan

[21] Appl. No.: 816,770

[22] Filed: Jul. 18, 1977

[30] Foreign Application Priority Data

Jul. 16, 1976 [JP] Japan ..... 51-84766

[51] Int. Cl.[2] ..... B41J 1/48

[52] U.S. Cl. ..... 101/93.28; 101/99; 101/110

[58] Field of Search ..... 101/93.21, 93.28, 93.29, 101/93.3, 93.31, 99–101, 106–108, 110; 178/33 R, 34, 27; 340/357, 358

[56] References Cited

U.S. PATENT DOCUMENTS

| | | | |
|---|---|---|---|
| 1,645,209 | 10/1927 | von Pein | 101/110 X |
| 1,968,347 | 7/1934 | Ochsenbein | 101/110 X |
| 2,157,497 | 5/1939 | Petty | 101/110 |
| 2,627,807 | 2/1953 | Buhler | 101/93.31 |
| 2,699,857 | 1/1955 | Wales | 197/1 R |
| 2,966,843 | 1/1961 | Eckley | 101/110 |
| 3,011,790 | 12/1961 | Brunson | 101/101 X |
| 3,179,044 | 4/1965 | Schierbeek | 101/93.28 |
| 3,422,754 | 1/1969 | Bakardjiev et al. | 101/110 X |
| 3,954,055 | 5/1976 | Hanaoka | 101/99 |
| 4,054,089 | 10/1977 | Okabe | 101/110 X |

FOREIGN PATENT DOCUMENTS

| | | | |
|---|---|---|---|
| 2,052,302 | 4/1972 | Fed. Rep. of Germany | 101/110 |

*Primary Examiner*—Paul T. Sewell

*Attorney, Agent, or Firm*—Blum, Moscovitz, Friedman & Kaplan

[57] ABSTRACT

In a printing device, printing type rings are mounted on a rotatable, grooved shaft. Each ring has associated therewith a pawl and a selecting mechanism for engaging the pawl with a selected groove on the printing type ring whereby a selected character on the ring may be brought to an inking position and then to a printing position. Retraction of the pawl by said printing mechanism disengages the pawl and allows the ring to reach a rest or stand-by position.

By the use of the retractable pawl a printing device is provided in which only those rings which are about to be used for printing are rotated, and the load on the inking mechanism is greatly decreased. The printing device may therefore be decreased in size and in energy consumption and the wear on the various members of said device is greatly decreased.

7 Claims, 8 Drawing Figures

FIG. 7
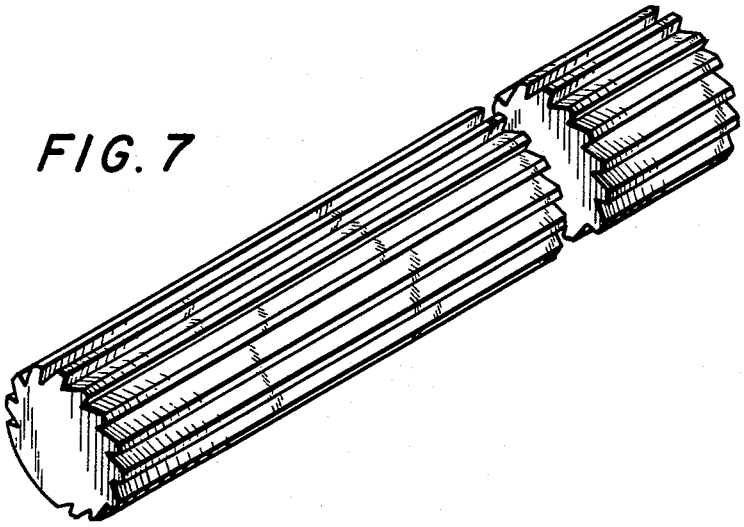
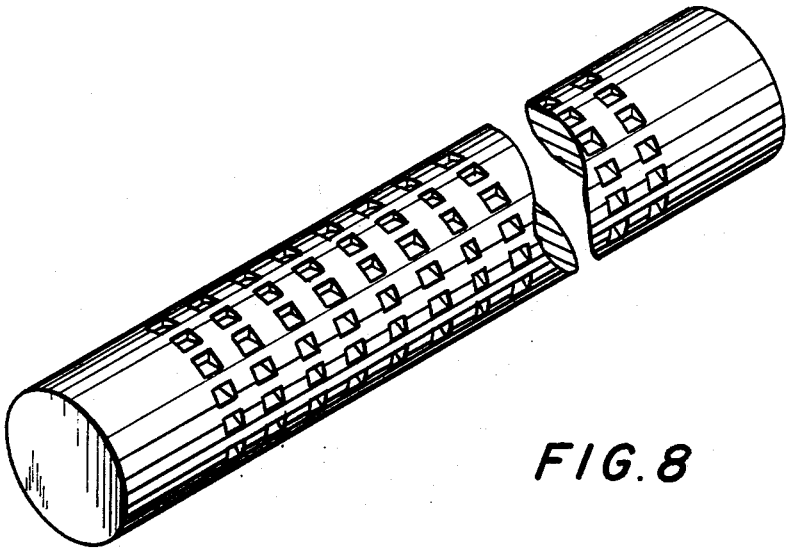
FIG. 8

SELECTING MECHANISM FOR PRINTING TYPE RINGS

BACKGROUND OF THE INVENTION

Due largely to the development of the small computer, there has simultaneously developed an urgent need for a printing device of simple construction which is small in size, light in weight and low in price. Simplicity in the construction makes it easy and inexpensive to replace the device, either in part or completely, if necessary. Also, the likelihood of failure is diminished and servicing is both easy and inexpensive. However, the constructions now in use suffer from a number of deficiencies which can be understood from an examination of a conventional device such as is shown in FIG. 1. As the mechanism for selecting a character on the printing type ring for printing, a printing type ring shaft 1 has a groove 2 on its periphery. The shaft supports printing type rings 5 each of which has type face characters 3 on its periphery. The rings engage frictionally with groove 2 by means of a printing type ring spring 4 for rotation in the direction of arrow *a*. When a desired character 3 has reached the printing position 10, a selecting pawl 8 is rotated in the direction of arrow *b* by a selecting electromagnet 6 and a selecting spring 7. The pawl engages with a ratchet tooth 9 on the side face of printing type ring 5, thus stopping said ring 5. Shaft 1 continues to rotate, however, and accordingly, groove 2 is so shaped that printing type ring spring 4 pulls out of groove 2 on said printing type ring shaft 1 and rides on the periphery of said printing type ring shaft 1, thereby disengaging ring 5 from shaft 1. Then, printing is effected by bringing a hammer 11 which is opposed to ring 5 at printing position 10 against printing paper 12 placed between the hammer 11 and ring 5.

This conventional device is so constructed that after printing of the selected character takes place, the shaft 1 rotates in the direction of arrow *c* whereupon the corresponding ring spring 4 of the selected ring 5 hooks into groove 2, groove 2 being so shaped that the ring spring 4 cannot disengage from the corresponding grooves when the rings are rotating in the *c* direction.

Conventional printing mechanisms use either frictional engagement between the ring and the shaft or coil springs to effect the engagement. In such constructions, when printing depends on the transfer of ink from an ink roll (not shown in FIG. 1) to the characters, and where the printing type rings 5 must stop and rotate in both directions, both sliding contact and rolling contact between the ink roll and the printing type rings 5 are effected. Under such circumstances both types of contact but, especially sliding contact, result in wear and deformation of the ink roll by the characters as a result of which the durability of the ink roll is adversely affected. A further point of great importance is that the drag on the rings produced by contact with the ink roll is substantial, as a result of which it becomes necessary to use large, heavy drive means which consume substantial amounts of power. An additional difficulty is that the drag imposed by the ink roll on the rings during selection frequently produces errors in selecting the desired characters.

These difficulties have been recognized, but the steps taken to overcome them have increased the weight and size of the mechanism. In order to overcome the tendency to err in the selection of characters to be printed, the load on the printing type ring springs 4 has been increased. However, this increases the load on the whole mechanism making it difficult to obtain sufficient functional reliability. The problem occurs and is serious when said ink roll is brought in contact with the type ring either during the selection process or in the return process. In trying to eliminate this problem any increase in the number of process steps is undesirable because the printing speed is decreased proportionately. Furthermore, in such an improved process the ink roll must not be brought in contact with the ring during the selection and return processes, so it is required that whatever mechanism be used that the ink roll be brought in contact with the rings only intermittently, but a mechanism for carrying out such a step is apt to be expensive.

As to the mechanism for turning the ring shaft alternately in both directions, in one type of device energy is stored in a torsional coil spring at the moment of reversing the direction of rotation of the shaft. This involves the use of gearing which can be disengaged at the moment of reversal of the direction of rotation, together with a mechanism for changing gears so that the mechanism is complex. The energy loss in such a mechanism is great and the wear problem is serious due to the impact of the torsional spring. Furthermore, the impact noise is great making it difficult to use such a mechanism in an enclosed space. Moreover, the accuracy of the gears used must be very high so that the gears become expensive, and even then actuation is unstable and lacks reliability.

In the mechanism shown in FIG. 1 where printing type ring springs 4 connect the ring 5 frictionally with printing type ring shaft 1, additional energy must be supplied to pull the springs 4 out of groove 2 and to slide the end of springs 4 along the periphery of shaft 1 after the rings 5 have been stopped for the printing step. Since the number of rings on a shaft may be as large as 40 or even more, the total load imposed on the drive mechanism becomes large so that the energy consumption of the whole mechanism leads to the need for large, heavy and expensive components.

As aforenoted, printing mechanisms have thus far incorporated the feature that the rings carrying the characters 3 rotate with the ring shaft 1 when they are not selected for printing and the rings 5 are stopped only when they are selected, after which resetting of the rings 5 is effected by the reverse rotation of shaft 1. Also, as aforenoted, the use of an ink roll in such a mechanism has introduced the problems of durability of the ink roll, erroneous selection of characters 3, increase in the load on the drive mechanism, serious decrease in the printing speed and increase in the cost of the mechanism itself and the products produced by such a mechanism. In the use of a reciprocating mechanism such as is shown in FIG. 1 where the mechanism depends on a printing type ring shaft 1 and pawl and groove combinations for selecting specific characters 3, the energy consumption is great whereas it is extremely desirable that the energy consumption be low, both from the standpoint of the initial cost of the components and from the cost of operation. Moreover, the reciprocating mechanism of a device such as is shown in FIG. 1 comprises a large number of parts which must be made with high precision and are consequently expensive. It would be desirable to reduce both the power consumption needed the size of the components and their cost. It would also be desirable that the device be simplified and freed of the need for expensive, high-precision components.

SUMMARY OF THE INVENTION

Generally speaking, a device in accordance with the present invention has a shaft which rotates only in a single direction and a plurality of printing type rings mounted on said shaft and means associated for selectively engaging each of said rings with said shaft for rotation therewith. The shaft has essentially longitudinal grooves thereon, the number of grooves corresponding to the number of characters on the peripheral face of each ring. On the side face of each ring is a pawl biased for engagement with the grooves on the shaft. A trigger mechanism is associated with each pawl on each ring. An electromagnet, when supplied with a current pulse disengages the trigger mechanism from the pawl allowing the pawl to drop into a selected groove on the shaft, said groove corresponding to a selected character on the printing type ring. An ink roll makes contact only with the character to be printed as the character is carried around the shaft. The ring rotation is continued until the selected character reaches a printing position. When the selected character on each of the selected rings has been brought to the printing position, a cam-actuated hammer strikes against the character with the medium to be printed, such a medium being a paper, between the printing hammer and the character. Rotation of the ring in the original direction then continues until the ring reaches a rest or stand-by position, the ring remaining in this position until it is once more selected, so that any ring rotates only when a character thereon is to be printed. During the step of returning the ring to the rest position the trigger mechanism is reset so that it is ready for the next printing operation.

In a preferred embodiment there is a single, large gap on the face of each ring, said gap being so located that it is opposed to the corresponding printing hammer when the ring is in rest position. This gap may be provided with a depression into which the ink roll fits with clearance when the ring is in rest position. In one embodiment of the invention, the ink roll rides on an arm which is spring-biased toward the printing rings. A rotating cam holds the ink roll away from the rings except during the period when a specific character is to be inked.

In general, grooves extending essentially the full length of the shaft are provided. However, as is evident, only those portions of each groove which can receive a pawl actually functions in the mechanism. Consequently, the grooves need not be continuous along the length of the shaft but need only be present at those locations on the shaft where they are to function in combination with a pawl. In some cases, the construction of the shaft is simplified if appropriately aligned depressions or indentations are provided on the surface of the shaft rather than grooves thereon.

Accordingly, it is an object of the present invention to provide a printing mechanism of extremely low power consumption, low noise level and high printing quality.

Another object of the present invention is a printing mechanism of simple construction, small size, light weight and low price.

A further object of the present invention is a printing mechanism which, in part, achieves the above objectives by an arrangement in which only those rings having characters to be printed rotate with the shaft on which the rings are mounted.

An important object of the present invention is a printing mechanism in which an ink roller makes contact only with those characters to be printed in the immediately subsequent printing operation, thereby decreasing the load on the driving mechanism for the printing device.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 7 and 8 are views in perspective of shafts on which printing type rings are to be mounted.

DESCRIPTION OF THE PREFERRED EMBODIMENTS

Figure 1:
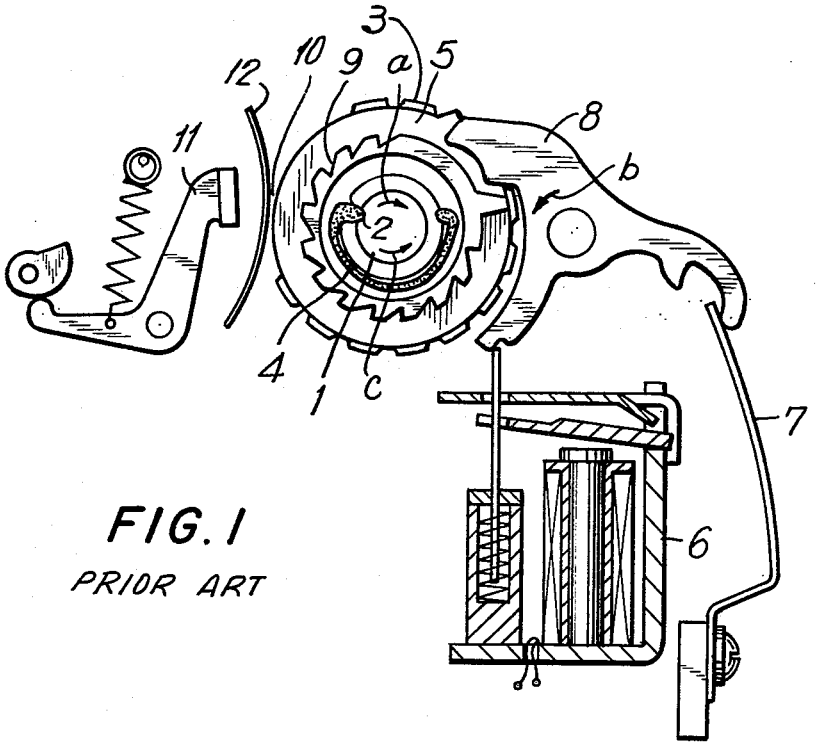
FIG. 1 PRIOR ART
FIG. 1 is a side view in partial section of a conventional printing mechanism of the type utilizing selection of a printing type ring.
Figure 2:
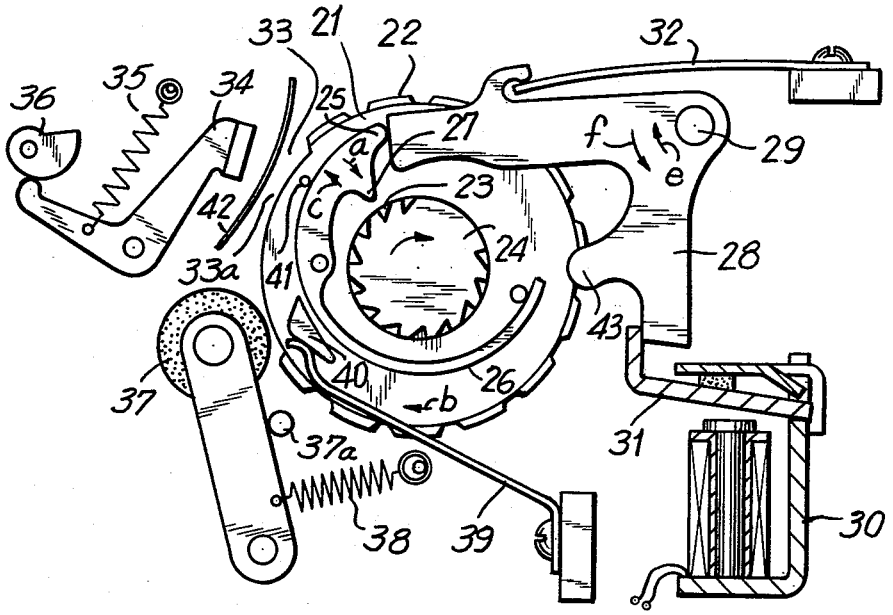
FIG. 2 is a side view in partial section of an embodiment of subject invention.

An embodiment of a printing device in accordance with subject invention is shown in FIG. 2. Printing type rings 21 having characters 22 on the periphery thereof are supported on printing type ring shafts 24 having grooves 23 oriented in the thrust direction on the periphery of said shaft 24. The number of grooves corresponds to the number of characters on the rings 21. A selecting pawl 25 is fixed to a side face of each ring 21 and each pawl has a spring portion 26 biased to bring pawl portion 27 into engagement with grooves 23 on shaft 24. Associated with each pawl 27 is a trigger lever 28 which controls engagement and disengagement of pawl 27 with the grooves 23 on shaft 24. Trigger lever 28 is supported by shaft 29 and actuated by electromagnet 30 through a traction plate 31 and selecting spring 32.

A printing hammer 34 is positioned opposite each ring 21 at a printing position 33. When the ring 21 is in rest position as shown in FIG. 2, a portion **33*a* of ring 21, said portion 33*a* being free of type characters, is positioned opposite hammer 34**.

Hammer 34 is biased toward ring 21 by hammer spring 35 and strikes against paper 42 and type character 22 thereunder when released by cam 36. Ink roll 37 is disposed proximate hammer 34 and is biased toward characters 22 by ink-roll spring 38. Stop **37*a* holds ink roll 37 away from portion 33*a* of ring 21 but allows said ink roll 37 to make contact with character 22** when in the appropriate position.

Figure 3:
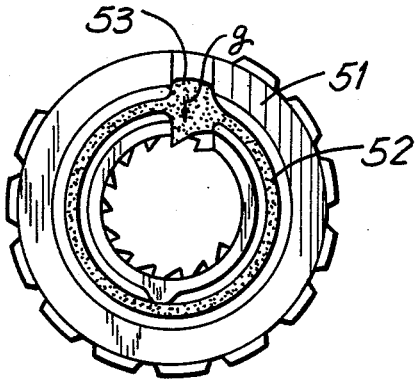
FIGS. 3 and 4 are further embodiments of subject invention shown in side view and in partial sections.
Figure 4:
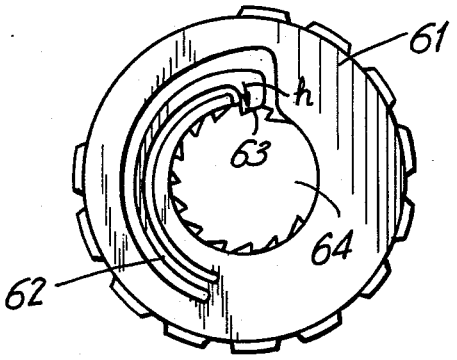

FIG. 2 shows one embodiment of pawl 25 in which said pawl is affixed to the side face of ring 21. Another embodiment of a selecting pawl is shown in FIG. 3, selecting pawl 53 being attached slidably to the side face of printing type ring 51, said pawl having a spring portion 52 biasing said pawl 53 in the direction indicated by the arrow *g*. Yet another embodiment is shown in FIG. 4 in which a printing type ring 61 has integral therewith a pawl having a spring portion 62 and a claw 63 for actuation in the direction indicated by the arrow *h* to engage printing type ring shaft 64.

A ring in a waiting position as shown in FIG. 2 is subjected to a turning force in the direction of arrow *b*, said force being imparted by rotating shaft 24, said shaft rotating in the direction indicated by the arrow *d*. To hold the ring in the waiting position, each ring 21 is provided with a projection 40 on the side face thereof, said projection 40 engaging a positioning spring 39. It will be understood that springs 32, 35 and 38, shaft 24 as well as other components as can be understood from the Figures are mounted on an appropriate frame, not shown.

The trigger levers 28 engage with selecting pawls 25 and thereby hold rings 21 in the rest position. In the act of making engagment with each selecting pawl 25, trigger lever 28 rotates tooth 27 in the direction indicated by the arrow *c* and thus out of engagement with rotating shaft 24.

As aforenoted, shaft 24 rotates only in the direction of arrow *d*, but those printing rings 21 which are not selected for printing remain in the waiting state as shown in FIG. 2. To print a selected character 22 on a specific ring 21, a current pulse is supplied to the corresponding electromagnet 30 to pull attraction plate away from trigger lever 28, thus permitting said lever to rotate in the direction indicated by the arrow *e* under the action of spring 32. Trigger lever 28 is thus disengaged from selecting pawl 25 so that tooth 27 enters groove 23 under the biasing action of spring portion 26, thereby causing printing type ring 21 to turn together with shaft 24 as a unit.

Selection of characters on specific rings 21 is thus carried out by the corresponding electromagnets 30 and the associated mechanical components. The characters to be printed are brought into a single line just before coming in contact with ink roll 37. They make contact with said ink roll 37 and receive an appropriate amount of ink after which said characters are turned to printing position 33. The selected characters are then brought in a single line to the printing position and hammers 34 are then driven by hammer springs 35 to collide with the paper 42 positioned immediately over the characters to be printed, hammers 34 being released by hammer cam 36.

After completion of printing, shaft 24 is turned further in the *d* direction causing selecting pawls 25 to collide with trigger levers 28, which have already been turned to the waiting position, in a manner to be described. Said selecting pawls 25 are turned in the direction of the arrow *c* as the result of engaging trigger levers 28, the excursion of selecting pawls 25 in the direction *c* being limited by stop 41. Simultaneously with the stopping of the rotation of ring 21 by trigger lever 28, positioning spring 39 engages projection 40. Printing type ring 21 continues to turn in the direction of arrow *b* until selecting pawl 25 hits stop 41, the sum of these actions setting up the waiting state.

Means for resetting all of the trigger levers 28 simultaneously can be provided, such means not being shown in the Figure. However, a preferred means is to use the projection 40, said projection 40 colliding with arm 43 of trigger 28 to rotate trigger lever 28 in the direction indicated by the arrow *f*. This mechanism reduces the number of parts required as well as the time for returning the trigger lever to the position for engaging pawl 25. Further, the reliability of this technique has been found to be high.

As aforenoted, the printing mechanism disclosed herein is such that those printing type rings 21 which are not selected for immediate printing of a selected character remain at rest. In other words, printing rings start rotating only after selection has been made, said selection being carried out through the medium of electromagnet 30. This type of action is contrary to that of the conventional printing mechanism. Moreover, if ink roll 37 is so arranged that it does not come in contact with the characters on a stationary ring 21, then the contact between a selected ring 21 and the ink 37 is always in the form of a rolling contact so that wear and deformation of ink roll 37 are small, thus providing for greatly increased durability and reduction in energy consumption.

Figure 5:
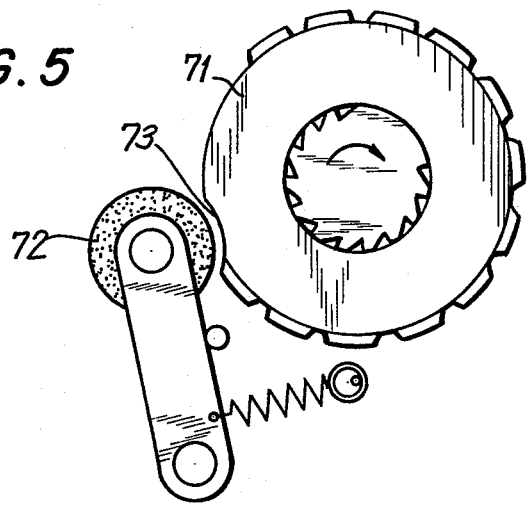
FIGS. 5 and 6 show ink rolls and printing type rings in side view on a shaft in partial section.

To insure that rings 21 stop at the waiting position and that the ink roll 37 does not come in contact with the characters, as shown in FIG. 2, a preferred construction such as is shown in FIG. 5 may be employed. In said construction a notch or depression 73 is formed in each ring 71 at a position in registry with ink roll 72 when said ring is in the waiting position. Another important feature of the ink roll mechanism in accordance with the present invention is the fact that said ink roll is brought in contact with characters on rings 21 only when the selection process is complete.

In the conventional mechanism bringing the ink roll 37 in contact with printing type rings 21 during the selection process gives rise to various problems such as rapid wear of the ink roll and erroneous selection. However, in a mechanism according to the present invention, even when the ink roll is brought into contact with the characters during the selecting process rapid wear of the ink roll and erroneous selection of characters do not result, the reason being that engagement of the selecting pawls 25 and shaft 24 is never released.

Figure 6:
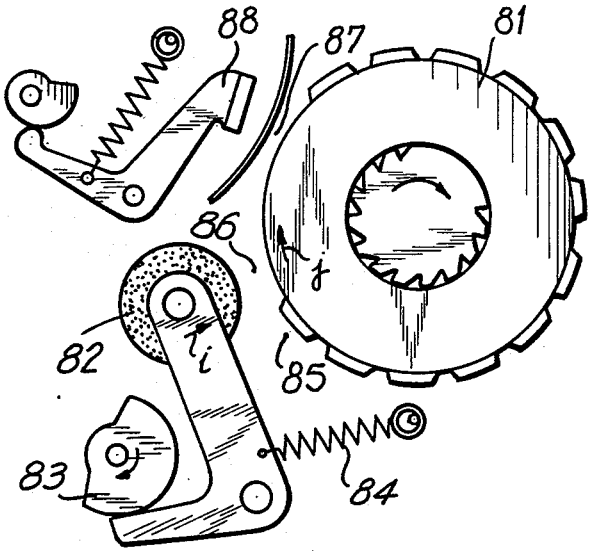

Another embodiment of the invention is shown in FIG. 6 in which ink roll 82 is biased toward the characters on printing type ring 81 by spring 84, spring 84 acting to rotate the arm supporting ink roll 82 in the direction indicated by the arrow *i*. Cam 83, rotating in the direction shown by the arrow on the face thereof controls the motion of said arm.

Cam 83 is so phased that the ink roll makes contact with the selected characters only when they have arrived in a line at the position indicated by the reference numeral 85. At this moment, ink roll 82 is moved in the direction of arrow *i* by cam 83 and driving spring 84 to come in contact with the selected letters, transferring ink to same.

Those printing type rings 81 to which ink has been applied are turned further in the direction of arrow *j* so that the aligned characters are brought into registry with hammers 88 and printing is carried out.

It should be noted that although the inking mechanism has been described in terms of an ink roll, any member such as a pad or similar means for inking the characters can be employed. Based on the mechanism shown in FIG. 6, the wear of the pad and the load imposed on the means for driving the shaft can be greatly reduced. Also, since the transfer of ink is part of the selection process and can proceed simultaneously therewith the printing speed is high and a simple mechanism results.

It should be noted that the printing type ring shaft of the various embodiments may be in either continuous rotation or intermittent rotation, stopping at the printing position and also, if desired, at the inking position. However, it is sufficient that the selection process be carried out during one revolution, the entire mechanism returning to the rest position during said one revolution. Consequently, the need for storing energy as in a torsion coil spring or the like, such as is employed in conventional mechanisms, disappears. In the device as disclosed herein, it is sufficient to employ only those members shown so that the mechanism is simple, the power requirements are low and the cost is low. Also, the energy consumption is low and the noise level resulting from the use of the mechanism is low.

Moreover, during the process of selecting specific characters for printing, those rings which are not to be used in the subsequent printing step do not rotate so that the inertia load imposed by the rings on the shaft is lower than in the conventional mechanism. Also, the frictional load due to springs applied to the printing type ring after the selection disappears.

As can be seen from FIGS. 7 and 8, longitudinally arranged grooves are provided on the periphery of the shaft on which the rings are mounted. The grooves are oriented in the thrust direction. Grooves such as are shown in FIG. 7 can readily be made by projection molding and deformation of bars. Accordingly, the cost is low. Further, as shown in FIG. 8, grooves can be provided only at those portions of the periphery which correspond to the selecting pawls 25 in FIG. 2, the remainder of the peripheral surface being allowed to stand without grooves.

Using the construction of the shaft as shown in FIGS. 7 and 8 the number of parts in the mechanism is small so that the cost of assembly is low, thus providing an inexpensive mechanism for carrying out rapid printing.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A printing device, comprising a plurality of printing type rings having type face characters on the peripheries thereof, a rotatable printing type ring shaft having grooves on the periphery thereof, said printing type ring shaft supporting said printing type rings, a pawl member provided on each of said printing type rings, said pawl member being biased by biasing means to engage with said grooves of said printing type ring shaft, a plurality of selecting means for selectively bringing a corresponding pawl member into and out of engagement with a selected groove of said printing type ring shaft and thereby causing a corresponding ring to rotate, and printing means for carrying out printing in cooperation with said printing type rings on a print-receiving member when placed therebetween, each of said printing-type rings rotating with said shaft only when the corresponding selecting means effects engagement of the pawl member with a selected groove of the rotating shaft.

2. The printing device as defined in claim 1, further comprising holding means for bringing each of said rings to rest following rotation and for holding said each ring in a rest position until a character of said each ring is selected for printing.

3. The printing device as defined in claim 1, wherein said pawl member biasing means is a spring.

4. The printing device as defined in claim 1, wherein the periphery of said printing type ring has a blank section thereon free of characters, said ring has a rest position in which said ring rests when not in rotation, said device has a printing position to which a character is brought in preparation for printing such that said blank section is at said printing position when said ring is in rest position.

5. The printing device as defined in claim 1, further comprising an ink roll for applying ink to the faces of said characters and wherein a character on each ring selected for the next printing may be brought into a line prior to bringing each of said selected characters to said ink roll for inking, thereby providing for inking all of said selected characters simultaneously.

6. The printing device as defined in claim 5, further comprising means for inking only said selected characters by said ink roll.

7. The printing device as defined in claim 1, wherein each of said grooves in said shaft extends substantially only over that portion of said shaft in registry with said pawl members.

* * * * *